US006272699B1

(12) United States Patent
Peterson

(10) Patent No.: US 6,272,699 B1
(45) Date of Patent: Aug. 14, 2001

(54) OVERFLOW DRAIN INSERT

(76) Inventor: Aaron L. Peterson, 2425 S. Progress Dr., Salt Lake City, UT (US) 84119

( * ) Notice: Subject to any disclaimer, the term of this patent is extended or adjusted under 35 U.S.C. 154(b) by 0 days.

(21) Appl. No.: 09/548,337

(22) Filed: Apr. 12, 2000

(51) Int. Cl.[7] ..... E03C 1/22; E03C 1/24

(52) U.S. Cl. ..... 4/680; 4/651; 4/679; 4/683; 4/686; 4/694

(58) Field of Search ..... 4/651, 674, 679, 4/680, 683, 686, 694, 695; 285/42, 56, 58, 59, 60; 137/386, 393

(56) References Cited

U.S. PATENT DOCUMENTS 215,891 * 5/1879 Dean ..... 4/668
2,444,340 * 6/1948 Donahue ..... 4/680
2,886,829 * 5/1959 Kadish ..... 4/694
4,077,430 * 3/1978 Brown et al. ..... 4/680
4,106,133 * 8/1978 Roberts ..... 4/621
4,669,131 * 6/1987 Barlow ..... 4/683

* cited by examiner

*Primary Examiner*—David J. Walczak
*Assistant Examiner*—Tuan Nguyen

(57) ABSTRACT

A method and apparatus for modifying a bathtub overflow drain to bypass potential leakage zones, i.e. between a bathtub liner and between connections of fittings through inserting a throat member from the innermost surface of the bathtub, which may be the innermost surface of a bathtub liner, to the interior of the standing portion of a drainpipe.

7 Claims, 2 Drawing Sheets

OVERFLOW DRAIN INSERT

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

Figure 1:
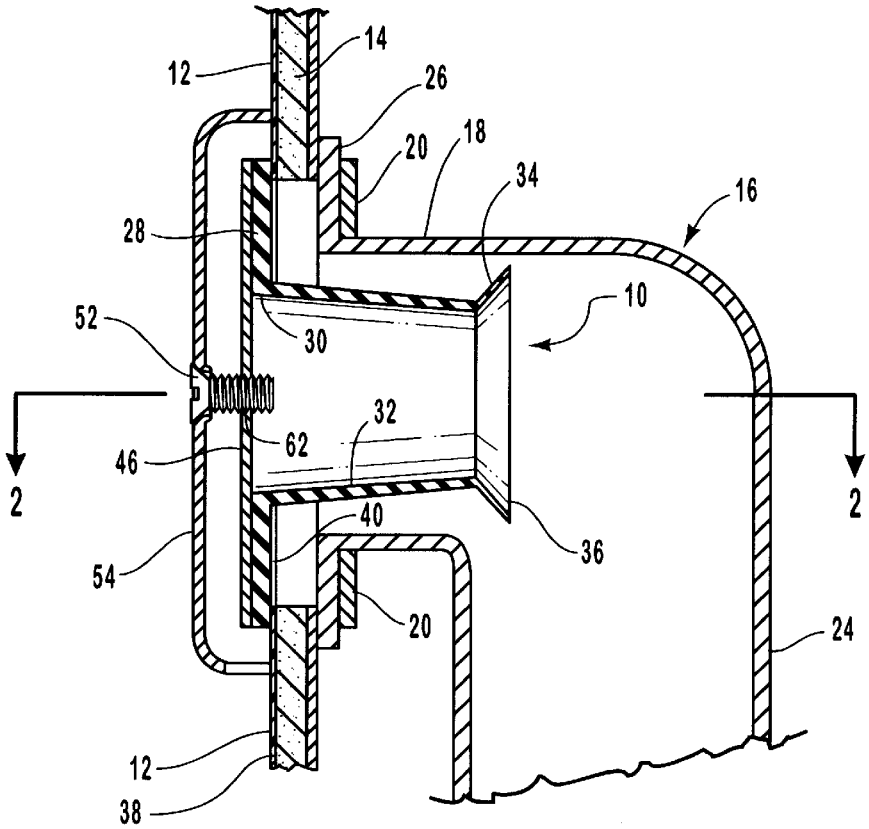

This invention relates to bathtub overflow drains and is particularly related to inserts for originally installed bathtub drains.

BRIEF SUMMARY OF THE INVENTION

In the installation of bathtubs it is common that an overflow opening of the bathtub be connected to a drainpipe having a standing portion also connected to the bathtub drain and discharging downwardly to a sewer connection. A portion at the upper end of the drainpipe is angled to connect to the overflow opening. After installation it is not unusual for a gasket, positioned between the angled upper end of the drainpipe and the bathtub wall surrounding the overflow opening, to leak. This may be due to improper installation of the gasket or may be because of hardening and/or deterioration of the gasket with the passage of time. In any event, leakage past the gasket can be damaging to bathtub support structure and may run down the outer face of the bathtub. The water on the bathtub then causes the tub to rust, often without knowledge of a user of the tub until an entire section of the tub wall disintegrates and it becomes necessary to replace the entire tub.

It is also common to provide a bathtub lining of plastic material that will cover worn and damaged visible surface areas of a bathtub; Such liners are frequently formed in one piece to cover all exposed surfaces of the tub. If a bathtub liner is installed care must be taken to seal the overflow opening through the liner and the aligned overflow opening of the bathtub to prevent water moving between the liner and the bathtub.

Principal objects of the present invention are to provide an insert fitting for connection of the inlet face of a bathtub drain opening with a drainpipe and to provide a fitting that is easily installed and that will discharge into the existing, standing portion of the drain pipe to carry away overflow water, without requiring modification or change of pre-existing overflow drain structure.

Other objects are to provide such an insert fitting that will accommodate the use of existing tub drain stopper operating mechanisms and that will effectively prevent seepage of overflow water flow between a tub liner and the wall of a bathtub in which a liner is installed.

Principal features of the invention include a throat that will mount to either a bathtub wall or a bathtub liner wall and that will extend through the overflow opening and an angled discharge pipe section, into the standing portion of the drainpipe, so that overflow water entering the throat from the bathtub is discharged from the throat into the standing portion of the drain pipe.

Still another feature of the invention is a flexible throat that will accommodate use of existing operating levers and linkages to control the bathtub drain valve while carrying overflow water past the drainpipe connection to the bathtub and into the standing portion of the drainpipe.

It is yet another feature of the invention that the shape of the throat insures flow of all water from the throat either back into the bathtub or into the standing portion of the drainpipe.

Other objects and features of the invention will become apparent to those skilled in the art to which the invention pertains from the following detailed description and drawings, disclosing what is presently contemplated as being the best mode of the invention.

DRAWINGS

Figure 2:
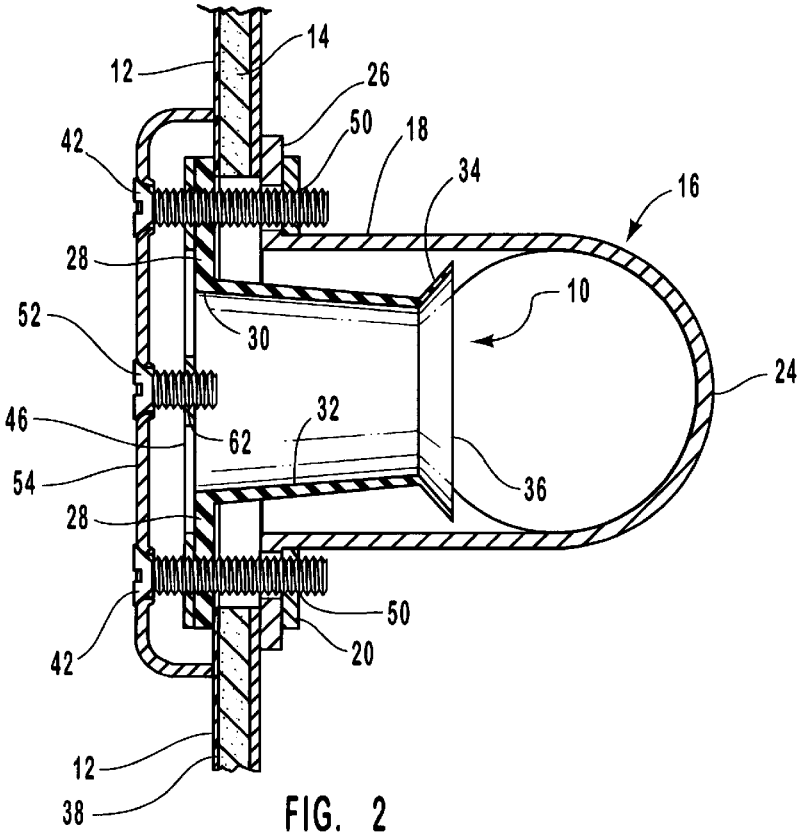
Figure 4:
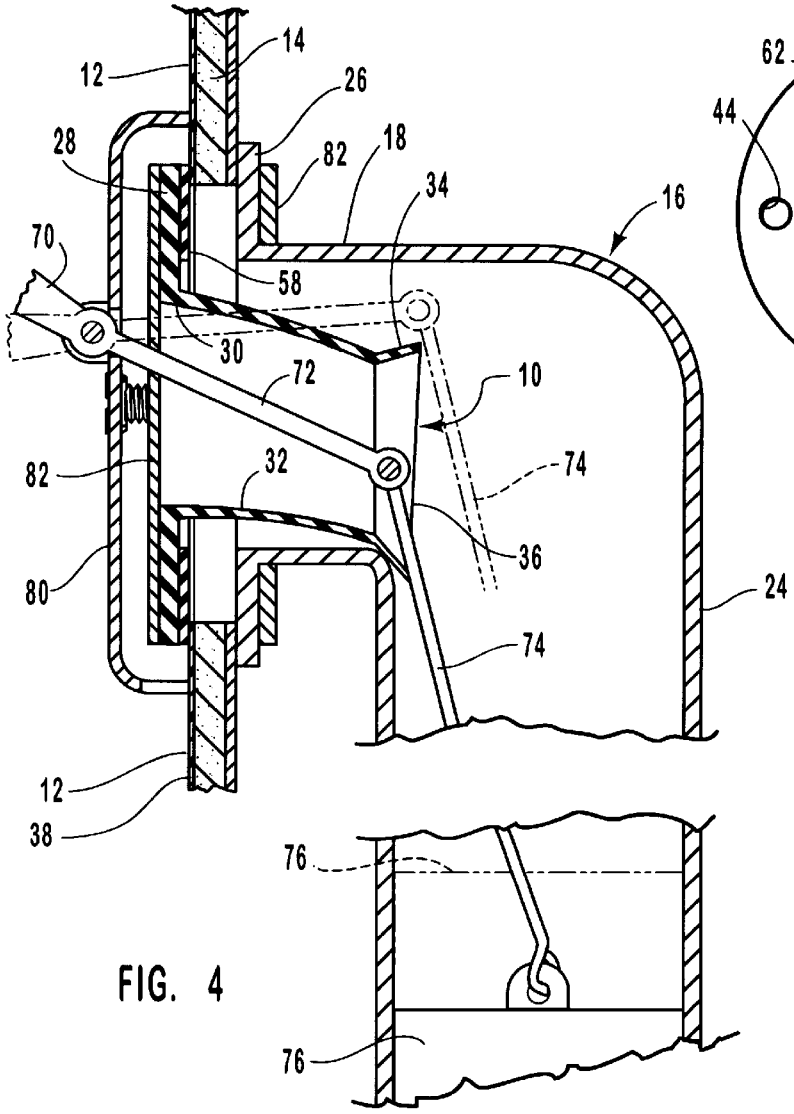
Figure 3:
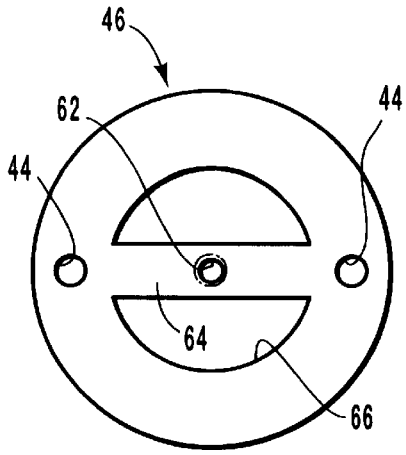
Figure 5:
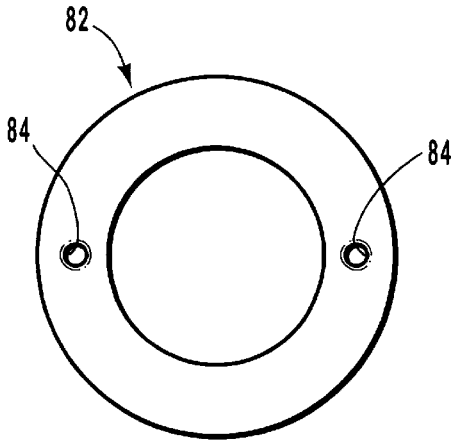
Figure 6:
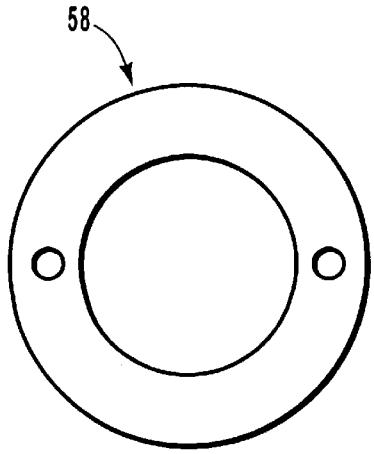

In the drawings:

FIG. 1 is a sectional view taken through a portion of a bathtub liner, a bathtub wall and centrally through the throat of the invention;

FIG. 2, a sectional view taken on the line 2—2 of FIG. 1;

FIG. 3, a front elevation view of a retaining plate for securing the throat of the invention and an overflow cover plate to a bathtub liner or a bathtub wall;

FIG. 4, a view like that of FIG. 1, but showing an alternate retaining plate suitable for use with a bathtub drain plug operating mechanism;

FIG. 5, a front elevation view of the alternative retainer plate of FIG. 4; and FIG. 6, a front elevation of a seal positioned between a flange of the throat and the bathtub liner or bathtub wall.

DETAILED DESCRIPTION

Referring now to the drawings:

In the illustrated preferred embodiment of the invention, a throat 10 is shown secured to a bathtub liner 12 and extending through the liner and a bathtub wall 14 and into a drainpipe 16. Drainpipe 16 includes an angled end portion 18, with an end flange 20 shown connected to the bathtub wall 14. The angled end portion 18 is shown forming a right angle connection with a standing portion 24 of the drainpipe 16, although it should be apparent that a connection other than a right angle connection may be provided between the angled end portion 18 and standing portion 24 and, in fact, in some instances the connections are curved or differently angled. A seal 26 is provided between end flange 20 and the bathtub wall 14. Seal 26 is the seal that often allows leakage of the water from the bathtub.

Throat 10 has a flange 28 surrounding and extending outwardly from an inlet end 30, a central wall portion 32 tapered from the flange 28 towards a flared wall portion 34, that terminates in a discharge end 36. Preferably, throat 10 is formed of a long lasting rubber, such as silicone rubber, or another rubber or plastic material that will be flexible, while generally maintaining its formed shape and capable of withstanding the corrosive effect of water, soap and other chemicals passed through the throat during use. Water in the throat 10 will either flow along tapered wall portion 32 back into the bathtub or through the flared wall portion 34 into the drainpipe 24. When made to be somewhat flexible, the throat can be bent during installation to allow it to fit into a drainpipe having an angled end portion other than the right angle configuration shown.

The length of throat 10, between flange 28 and the discharge end 36, is such that when flange 28 is positioned against the inner surface of liner 12, or if no liner is provided the inner surface 38 of bathtub wall 12. The central wall portion 32 and flared wall portion 34 of throat 10 extend through the angled end portion 18 such that the discharge end 36 terminates within the standing portion 24 of drainpipe 16.

As shown best in FIGS. 1–3, flange 28 of throat 10 is bonded to the face of bathtub liner 12, or, if no liner is provided, with the inner surface 38 of the bathtub wall 14 with a bead of adhesive 40. The flange 28 is further secured to the tub liner or bathtub with screws 42 inserted through holes 44 in the retainer plate 46, holes in flange 28 of the throat 10, aligned holes through the seal 26 and screwed into the threaded holes 50 of flange 20. A screw 52 through a cover plate 54 is screwed into a threaded hole 62 in a bar 64 that extends across the central opening 66 of retainer plate 46 secures the cover plate to the liner or bathtub wall.

A seal 58, FIG. 6 may be inserted between flange 28 of throat 10 and the liner (or bathtub) in place of the bead of adhesive 40, if desired As best seen in FIG. 4, the flexible throat 10 bends to accommodate use of a lever 70, and linkage arms 72 and 74 used to operate a drain valve 76 within the standup portion 24 of drainpipe 16. Such actuating mechanisms are well known, and generally extend through and are pivoted on a cover plate. In this embodiment a retainer plate 82 is used to secure the flange 28 of throat 10 in place. Screws inserted through holes in the cover plate and through the holes 84 of retainer plate 82, FIG. 5, hold the retainer plate 82 in place.

Although a preferred form of my invention has been herein disclosed, it is to be understood that the present disclosure is by way of example and that variations are possible without departing from the subject matter coming within the scope of the following claims, which subject matter I regard as my invention.

I claim:

1. An overflow drain insert for inserting into an overflow drain opening of a sanitary device, wherein the overflow drain opening is located on a substantially vertical wall of the sanitary device, said insert comprising:

a throat member having a central encircling wall having a passage therethrough; said wall and said passage being tapered inwardly from an inlet end to an outwardly flared wall;

a flange surrounding and extending outwardly from said inlet end; and said outwardly flared wall terminating in a discharge end of said throat member for allowing an overflow water to either exit from the sanitary device into a drainpipe or return to the sanitary device.

2. An overflow drain insert as in claim 1, wherein the throat member is constructed of a single piece of resilient material.

3. An overflow drain insert as in claim 2, wherein the resilient material is silicone rubber.

4. An overflow drain insert as in claim 1, wherein the sanitary device is a bathtub; said insert further including means for sealingly securing the flange of the throat to an interior surface of the bathtub surrounding the overflow drain opening, wherein the discharge end of said throat member is positioned in a standing portion of the drainpipe.

5. A method for improving a bathtub overflow drain, comprising inserting a throat member to extend from a bathtub liner wall into a bathtub overflow opening and through an angled upper portion of a bathtub drainpipe into a standing portion of said drainpipe wherein the throat member having a central encircling wall having a passage therethrough; said wall and said passage tapered inwardly from an inlet end to an outwardly flared wall; a flange surrounding and extending outwardly from said inlet end; and said outwardly flared wall terminating in a discharge end for allowing an overflow water to either exit into said standing portion or return to the bathtub.

6. A method as in claim 5, wherein the throat member is manufactured from flexible materials.

7. A method as in claim 6, wherein the throat member is bendable as bathtub drain valve actuating mechanism is operated through the throat.

* * * * *